US009088114B2

(12) United States Patent
Chen et al.

(10) Patent No.: US 9,088,114 B2
(45) Date of Patent: Jul. 21, 2015

(54) MULTIFUNCTION SOCKET DEVICE

(71) Applicants: Wen-Liang Chen, Kaohsiung (TW); Ying-Liang Yao, Kaohsiung (TW)

(72) Inventors: Wen-Liang Chen, Kaohsiung (TW); Ying-Liang Yao, Kaohsiung (TW)

(73) Assignee: SHU-TE University, Kaohsiung (TW)

( * ) Notice: Subject to any disclaimer, the term of this patent is extended or adjusted under 35 U.S.C. 154(b) by 123 days.

(21) Appl. No.: 13/958,610

(22) Filed: Aug. 5, 2013

(65) Prior Publication Data

US 2014/0302716 A1 Oct. 9, 2014

(30) Foreign Application Priority Data

Apr. 3, 2013 (TW) ..... 102112138 A

(51) Int. Cl.

| | |
|---|---|
| ***H01R 13/66*** | (2006.01) |
| ***H01R 13/717*** | (2006.01) |
| ***H01R 13/502*** | (2006.01) |
| ***H01R 24/66*** | (2011.01) |
| *H01R 13/62* | (2006.01) |
| *H01R 13/641* | (2006.01) |

(52) U.S. Cl.

CPC ..... *H01R 13/717* (2013.01); *H01R 13/502* (2013.01); *H01R 13/6625* (2013.01); *H01R 13/6675* (2013.01); *H01R 24/66* (2013.01); *H01R 13/6205* (2013.01); *H01R 13/641* (2013.01)

(58) Field of Classification Search

CPC ..... H01R 13/6658; H01R 13/514; H01R 13/719; H01R 23/025; H01R 23/005; H01R 13/7175; H01R 13/717; H01R 13/6641; H01R 13/641; F21S 9/03; F21S 8/035; F21S 8/00; F21K 9/00; F21K 9/17

USPC ..... 439/620.01, 490, 641, 94, 802; 362/95

See application file for complete search history.

(56) References Cited

U.S. PATENT DOCUMENTS

| | | | | |
|---|---|---|---|---|
| 5,442,258 | A * | 8/1995 | Shibata | 315/129 |
| 5,601,358 | A * | 2/1997 | Chien | 362/190 |
| 5,890,794 | A * | 4/1999 | Abtahi et al. | 362/294 |
| 6,340,233 | B1 * | 1/2002 | Shieh | 362/102 |
| 6,820,998 | B2 * | 11/2004 | Chen | 362/276 |
| 7,025,473 | B2 * | 4/2006 | Dokoupil | 362/640 |
| 7,851,981 | B2 * | 12/2010 | Altamura | 313/9 |
| 7,891,841 | B2 * | 2/2011 | Levine | 362/249.07 |
| 8,382,315 | B2 * | 2/2013 | Lee et al. | 362/217.08 |
| 8,382,321 | B2 * | 2/2013 | Lee et al. | 362/249.02 |
| 8,410,701 | B2 * | 4/2013 | Lee et al. | 315/51 |
| 8,410,702 | B2 * | 4/2013 | Lee et al. | 315/51 |
| 8,414,153 | B2 * | 4/2013 | Barta | 362/249.02 |
| 2004/0066142 | A1 * | 4/2004 | Stimac et al. | 315/50 |
| 2009/0154151 | A1 * | 6/2009 | Levine | 362/184 |
| 2010/0176743 | A1 * | 7/2010 | Lee et al. | 315/294 |
| 2012/0139446 | A1 * | 6/2012 | Koren et al. | 315/297 |

* cited by examiner

*Primary Examiner* — Abdullah Riyami
*Assistant Examiner* — Vladimir Imas

(57) ABSTRACT

A multifunction socket device is connected to a main AC power and comprises a frame unit, at least one power outlet, a cover unit and a first illuminating unit. The multifunction socket device can provide power source and illumination device, which bring more convenience and options to modern lifestyle.

9 Claims, 6 Drawing Sheets

MULTIFUNCTION SOCKET DEVICE

BACKGROUND OF THE INVENTION

1. Field of the Invention

The present invention relates to a power outlet device, and more particularly to a multifunction socket device.

2. Description of the Related Art

Electrical power socket is a very essential element for modern lifestyle. For different countries, the power outlet can have different designs, dimensions or specifications.

As shown in FIG. 1, a typical power socket comprises a power outlet 11, a framework 12 and a cover plate 13. The power outlet 11 has a plurality of outlet apertures 111. The power outlet 11 is attached on a wall via the framework 12 and partially covered by the cover plate 13. Therefore, the plurality of outlet apertures 111 (two or three apertures) of the power outlet 11 111 are exposed.

However, the typical power socket has following drawbacks:

1. Only one single function provided by the power outlet 11.

The typical power outlet can only provide power source not other

2. No attractive design for the power outlet 11

For modern lifestyle, the appearance of any household item is an important factor.

3. No indication for the status of the power outlet 11

The typical power outlet 11 does not provide any indication for the operation status.

Therefore, it is desirable to provide a multifunction socket device to mitigate and/or obviate the aforementioned problems.

SUMMARY OF THE INVENTION

An objective of the present invention is to provide a multifunction socket device.

In order to achieve the above mentioned objective, a multifunction socket device is connected to a main AC power and comprises a frame unit, at least one power outlet, a cover unit and a first illuminating unit.

The frame unit has a framework defining at least one accommodating space. The at least one power outlet is disposed on the accommodating space and electrically connected to the main AC power. The cover unit is disposed on the framework and has a plate and an opening on the plate. The opening accepts the power outlet, and the power outlet is assembled with the frame unit through the opening. The first illuminating unit is detachably disposed onto the plate and has a first housing. A first AC/DC converter is deposited in the first housing and connected to the main AC power. A first electric capacitor IS electrically connected to the first AC/DC converter, and a first lighting member electrically connected to the first electric capacitor.

The present invention can provide power source and illumination device, which bring more convenience and options to modern lifestyle.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
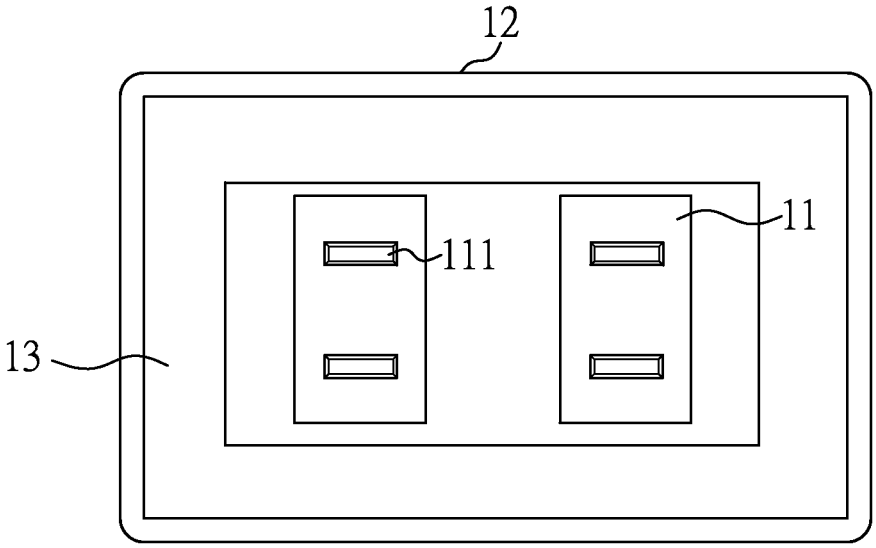
Prior Art FIG.1
FIG. 1 is a top view of a typical power outlet.
Figure 2:
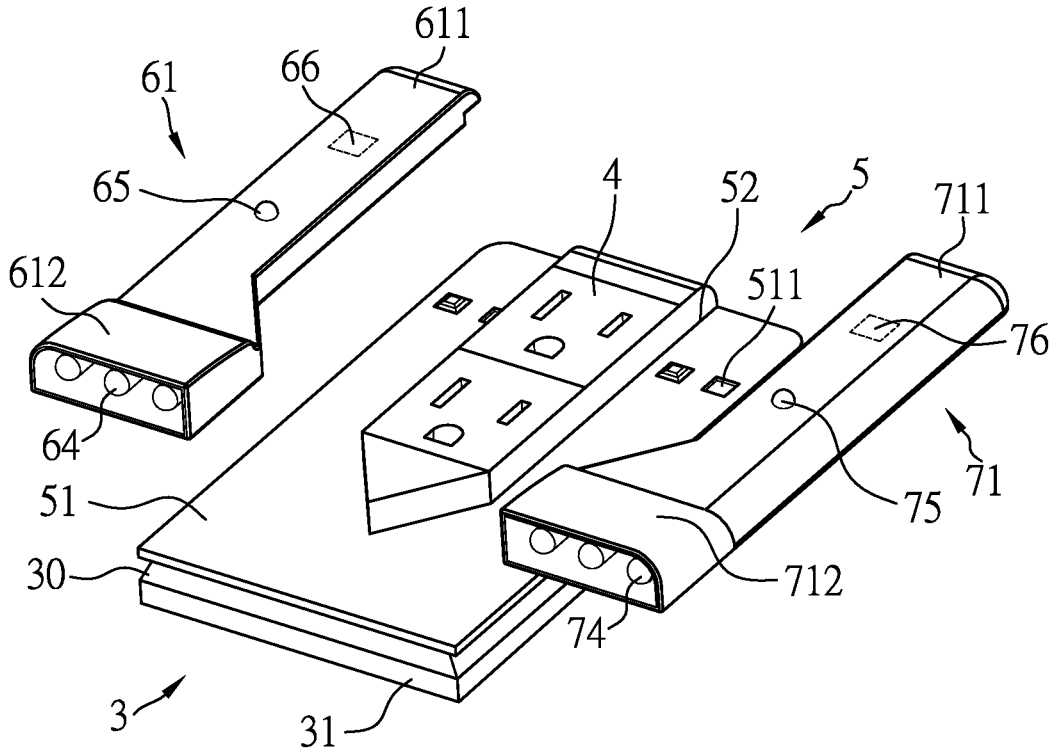
FIG. 2 is a perspective exploded view of a multifunction socket device according to an embodiment of the present invention.
Figure 3:
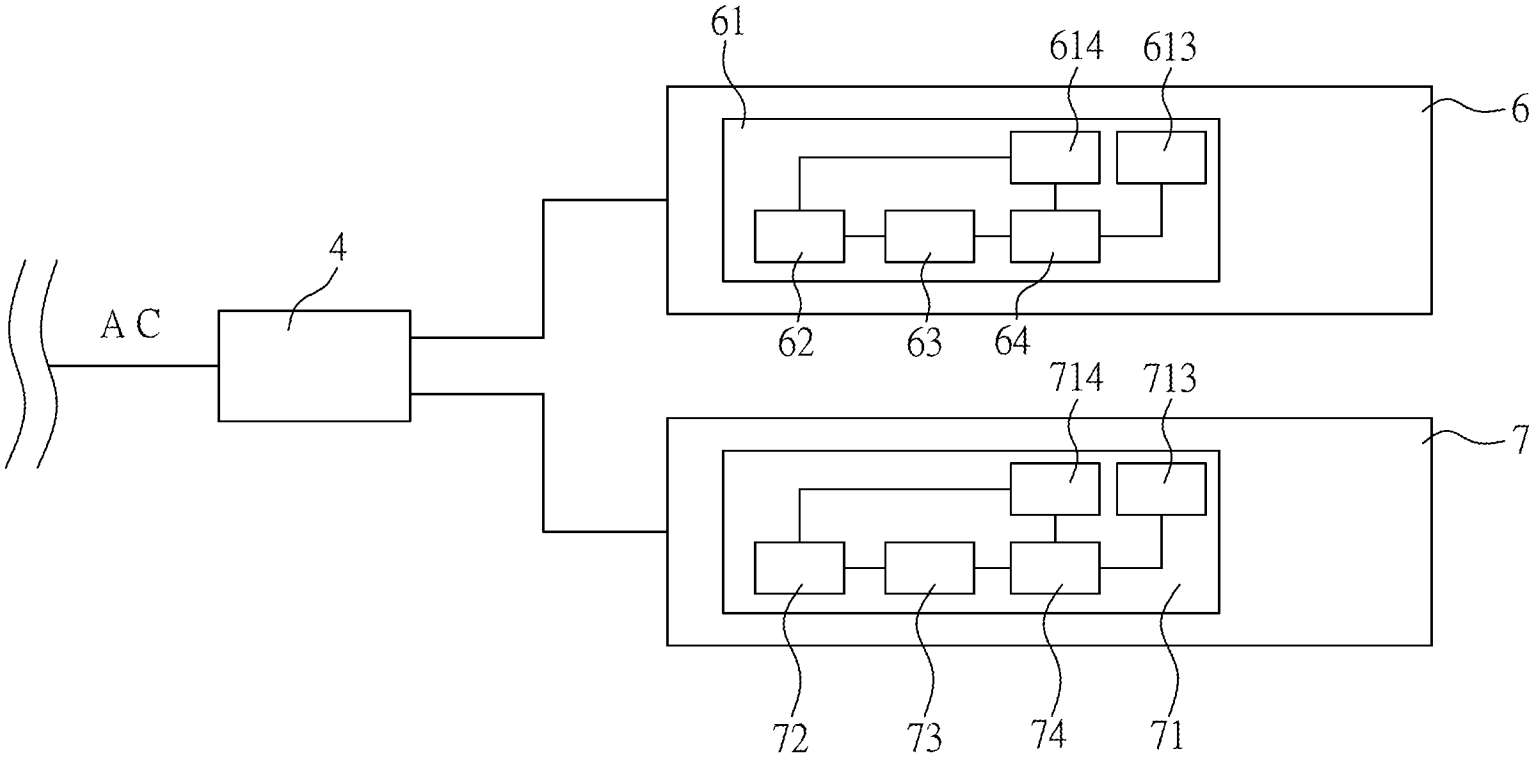
FIG. 3 is a block functional drawing explaining the connection relation between a multifunction socket device and a main AC power.
Figure 4:
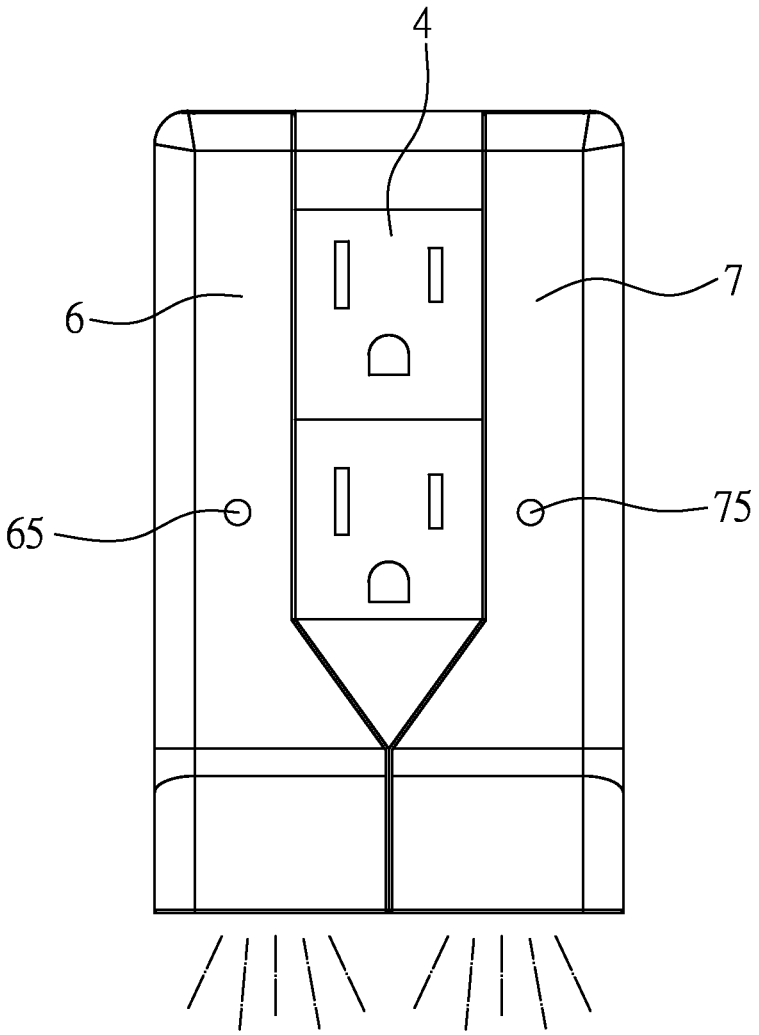
FIG. 4 is an assembly schematic drawing of the multifunction socket device according to the embodiment of the present invention.

Please refer to FIGS. 2, 3 and 4. A multifunction socket device is connected to a main AC power and comprises a frame unit 3, at least one power outlet 4, a cover unit 5, a first illuminating unit 6, and a second illuminating unit 7.

The frame unit 3 has a framework 31 defining at least one accommodating space 30. The power outlet 4 is disposed in the accommodating space 30 and electrically connected to the main AC power. The power outlet 4 can have various designs for the shape of the apertures and output power specifications for different countries standards.

The cover unit 5 is disposed on the framework 31 and has a plate 51 and an opening 52 on the plate 51. The opening 52 accepts the power outlet 4, and the power outlet 4 is assembled with the frame unit 3 through the opening 52. In a preferred embodiment of the present invention, there are two the power outlets 4 are disposed in the opening 52, but a number of the power outlets can be various or and be replaced by a power switch (not shown).

The first illuminating unit 6 is detachably disposed onto the plate 51 and has a first housing 61, a first AC/DC converter 62 deposited in the first housing 61 and connected to the main AC power, a first electric capacitor 63 electrically connected to the first AC/DC converter 62, a first lighting member 64 electrically connected to the first electric capacitor 63, and a first charge indication light 65 disposed on the first housing 61, and a first magnetic member 66 disposed on the first housing 61.

The first housing 61 has a first handle portion 611 and a first head portion 612 connected to the first handle portion 611. The first AC/DC converter 62 and the first electric capacitors 63 are disposed on the first handle portion 611, and the first lighting member 64 is disposed on the first head portion 612.

The first charge indication light 65 on the first housing 61 indicates the charging conditions of the first electric capacitors 63. The first magnetic member 66 on the first housing 61 is used for attaching onto the cover unit 5.

The second illuminating unit 7 is detachably disposed on the plate 51, and has a second housing 71, a second AC/DC converter 72 disposed on the second housing 71 and electrically connected to the main AC power, a second electric capacitor 73 electrically connected to the second AC/DC converter 72, a second lighting member 74 electrically connected to the second electric capacitor 73, a second lighting member 74 electrically connected to the second electric capacitor 73, a second charge indication light 75 disposed on the second housing 71, and a second magnetic member 76 disposed on the second housing 71.

The second housing 71 has a second handle portion 711 and a second head portion 712 connected to the second handle portion 711. The second AC/DC converter 72 and the second electric capacitor 711 are disposed on the second handle portion, and the second lighting member 74 is disposed on the second head portion 712.

In the preferred embodiment of the present invention, two metal connecting spots 511 are respectively disposed on the plate 51 corresponding to the first and second housings 61, 71 and used for allowing the first and second head portions 6, 7 to be electrically connected to main AC power.

The second charge indication light 75 on the second housing 71 indicates the charging conditions of the second electric capacitor 73. The second magnetic member 76 on the second housing 71 is used for attaching onto the cover unit 5. Furthermore, the first and second housings 61, 71 can by combined together by a magnetic attraction between the first and second magnetic members 66, 76.

The first and second housings 61, 71 have a first and second switches 613, 713 for controlling the first and second illuminating units 64, 74 and a first and second detecting circuits 614, 714 for detecting whether the main AC power and the first and second head portions 6, 7 are electrically connected. When the first and second detecting circuits 614, 714 detect the main AC power is not electrically connected to the first and second head portions 6, 7 and the first and second switches 613, 713 are turned off, the first and second detecting circuits 614, 714 make the first and second illuminating units 64, 74 to illuminate.

Alternatively, when the first and second detecting circuits 614, 714 detect the main AC power is electrically connected to the first and second head portions 6, 7 and the first and second switches 613, 713, the first and second detecting circuits 614, 714 make the first and second illuminating units 64, 74 not to illuminate. With the combination of the power outlet 4 and the first and second head portions 6, 7, light is generated below the power outlet 4, which can provide illumination during black out.

In the preferred embodiment, the first and second illuminating units 64, 74 electrically connected to the first and second electric capacitors 63, 73 are composed of a plurality of LEDs, which are low cost, long usage lifetime and small dimensions.

Figure 5:
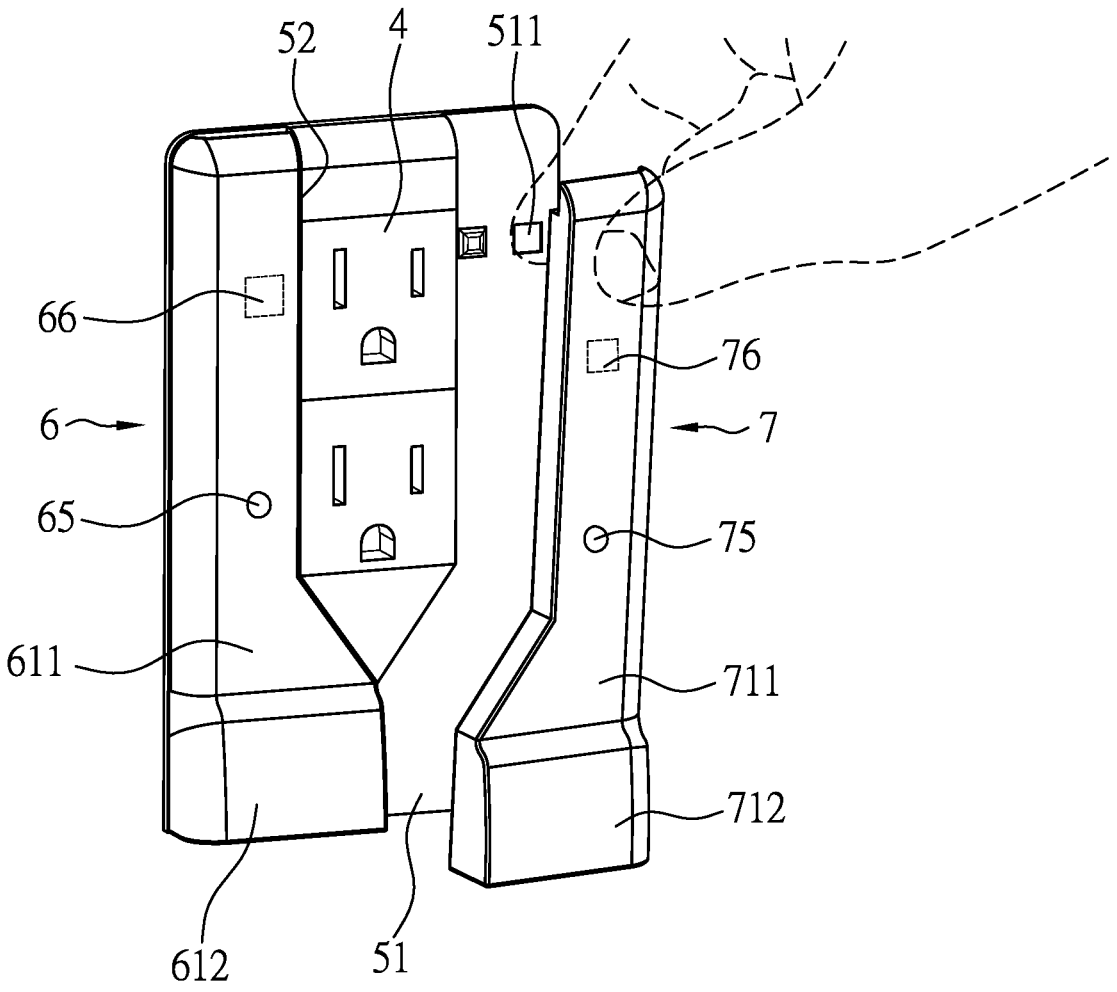
FIG. 5 is a perspective exploded view of showing a second illuminating unit being separated from a plate according to the embodiment of the present invention.
Figure 6:
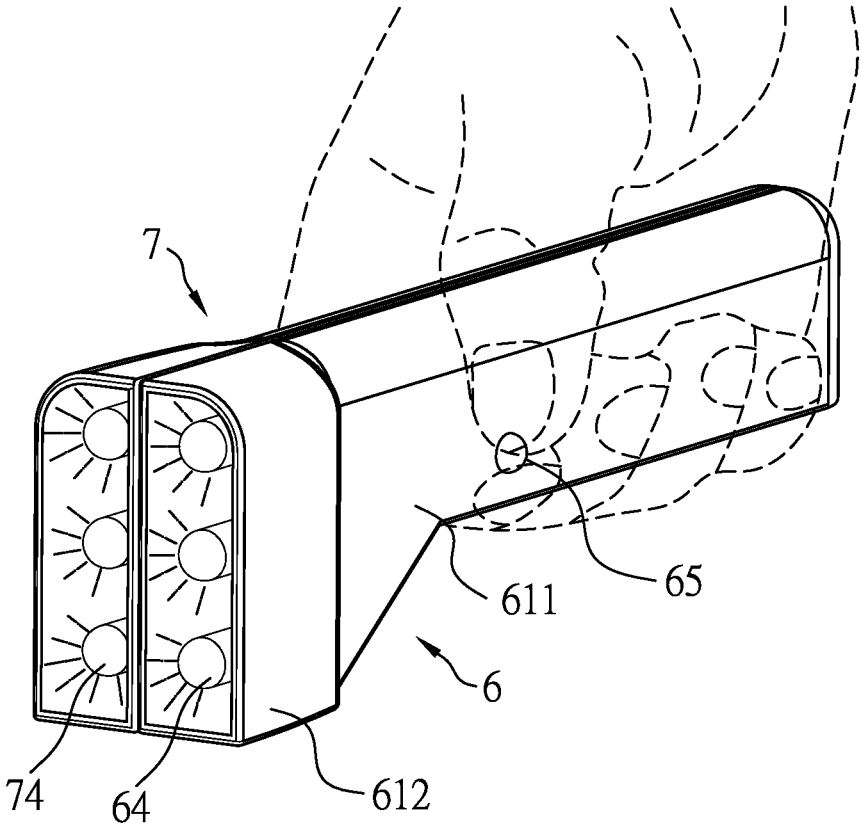
FIG. 6 is a local detail perspective view of showing a first and second head portions are combined together.

Please refer to FIG. 5 and FIG. 6. The first and second head portions 6, 7 are detachably attached onto the two sides of the power outlet 4 of the plate 51. During the black out, users can pull the first and second head portions 6, 7 apart from the plate 51 and combine the first and second head portions 6, 7 via the first and second magnetic members 66, 76 on the first and second housings 61, 71, to use them together as a flash light.

Moreover, the first and second charge indication lights 65, 75 can respectively provide two different light colors. The first and second charge indication lights 65, 75 both indicate a charging status with a red light and a non-charging status with a green light for the first and second electric capacitors 63, 73.

With above description, the multifunction socket device of the embodiment of the present invention has following benefits:

1. Multifunction Design

By the first and second detecting circuits 614, 714 detecting the connection between the power outlet the main AC power, the first and second head portions 6, 7 can provide illumination whenever the power is shut down. Furthermore, the first and second head portions 6, 7 are capable of being separated from the cover unit 5 and combined to become a flash light from emergency use.

2. Better Design Appearance

The first and second head portions 6, 7 are disposed around the power outlet 4 on the plate 51 which utilizes the remaining space. Furthermore, the first and second magnetic members 66, 76 allow the first and second head portions 6, 7 to be combined together.

3. Providing Charging Condition Indication

The first and second charge indication lights 65, 75 can respectively provide two different light colors. The first and second charge indication lights 65, 75 both indicate a charging status with a red light and a non-charging status with a green light for the first and second electric capacitors 63, 73.

Although the present invention has been explained in relation to its preferred embodiment, it is to be understood that many other possible modifications and variations can be made without departing from the spirit and scope of the invention as hereinafter claimed.

What is claimed is:

1. A multifunction socket device for connection to a main AC power source comprising:

a frame unit having a framework defining at least one accommodating space;

at least one power outlet disposed in the accommodating space and electrically connectable to main AC power;

a cover unit disposed on the framework and having a plate and an opening in the plate, the opening accepting the power outlet, and the power outlet assembled with the frame unit through the opening; and a first illuminating unit detachably disposed onto the plate and having a first housing, a first AC/DC converter disposed in the first housing and connectable to the main AC power, a first electric capacitor electrically connected to the first AC/DC converter, and a first lighting member electrically connected to the first electric capacitor;

wherein the first housing has a first handle portion and a first head portion connected to the first handle portion, the first AC/DC converter and the first electric capacitor are disposed on the first handle portion, and the first lighting member is disposed on the first head portion.

2. The multifunction socket device as claimed in claim 1, wherein the first illuminating unit further comprises a first charge indication light disposed on the first housing.

3. The multifunction socket device as claimed in claim 2, wherein the first illuminating unit further comprises a first magnetic member disposed on the first housing corresponding to a matching magnetic member on the cover unit.

4. A multifunction socket device for connection to a main AC power source comprising:

a frame unit having a framework defining at least one accommodating space;

at least one power outlet disposed in the accommodating space and electrically connectable to main AC power;

a cover unit disposed on the framework and having a plate and an opening in the plate, the opening accepting the power outlet, and the power outlet assembled with the frame unit through the opening;

a first illuminating unit detachably disposed onto the plate and having a first housing, a first AC/DC converter disposed in the first housing and connectable to the main AC power, a first electric capacitor electrically connected to the first AC/DC converter, and a first lighting member electrically connected to the first electric capacitor;

a second illuminating unit detachably disposed on the plate, the second illuminating unit having a second housing, a second AC/DC converter disposed on the second housing and electrically connected to the main AC power, a second electric capacitor electrically connected to the second AC/DC converter, and a second lighting member electrically connected to the second electric capacitor; the second housing having a second handle portion and a second head portion connected to the second handle portion; the second AC/DC converter and the second electric capacitor disposed on the second handle portion, the second lighting member disposed on the second head portion.

5. The multifunction socket device as claimed in claim 4, wherein the second illuminating unit further comprises a second charge indication light disposed on the second housing and a second magnetic member; the second charge indication light indicates the charging status of the second electric capacitor; the second magnetic member is used for being attached on to the cover unit; and the first and second housings are combined together via the first and second magnetic members.

6. The multifunction socket device as claimed in claim 5, wherein two metal connecting spots are respectively disposed on the plate corresponding to the first and second housings and used for allowing the first and second head portions to be electrically connected to main AC power.

7. The multifunction socket device as claimed in claim 6, wherein the first and second head portions are detachably disposed on two sides of the power outlet of the plate.

8. The multifunction socket device as claimed in claim 7, wherein the first and second charge indication lights both indicate a charging status with a red light and a non-charging status with a green light for the first and second electric capacitors.

9. The multifunction socket device as claimed in claim 8, wherein the first and second housings respectively have a first and second switches for controlling the first and second illuminating units and a first and second detecting circuits for detecting whether the main AC power and the first and second head portions are electrically connected; when the first and second detecting circuits detect the main AC power is not electrically connected to the first and second head portions and the first and second switches are turned off, the first and second detecting circuits make the first and second illuminating units to illuminate; the first and second detecting circuits detect the main AC power is electrically connected to the first and second head portions and the first and second switches, the first and second detecting circuits make the first and second illuminating units not to illuminate.

* * * * *